US009629516B2

(12) United States Patent
Chen et al.

(10) Patent No.: US 9,629,516 B2
(45) Date of Patent: Apr. 25, 2017

(54) DISHWASHER RACK HANDLE

(71) Applicant: Whirlpool Corporation, Benton Harbor, MI (US)

(72) Inventors: David H. Chen, Saint Joseph, MI (US); Demetrius J. Schaaf, Saint Joseph, MI (US); Michael S. Seeley, South Haven, MI (US); Jeffrey R. Taylor, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 225 days.

(21) Appl. No.: 14/509,315

(22) Filed: Oct. 8, 2014

(65) Prior Publication Data

US 2016/0100739 A1 Apr. 14, 2016

(51) Int. Cl.
*A47L 15/50* (2006.01)

(52) U.S. Cl.
CPC ..... *A47L 15/507* (2013.01); *A47L 15/50* (2013.01)

(58) Field of Classification Search
None
See application file for complete search history.

(56) References Cited

U.S. PATENT DOCUMENTS

| | | | | |
|---|---|---|---|---|
| 7,267,131 | B2 | 9/2007 | Woo | |
| 7,594,513 | B2 | 9/2009 | VanderRoest et al. | |
| D644,804 | S | 9/2011 | Baldwin | |
| D645,219 | S | 9/2011 | Baldwin | |
| 8,303,725 | B2 * | 11/2012 | Crookshanks | A47L 15/507 134/56 D |
| 2004/0163687 | A1 | 8/2004 | Son et al. | |
| 2011/0248609 | A1 | 10/2011 | Hoepfl et al. | |
| 2011/0266935 | A1 | 11/2011 | Baldwin et al. | |
| 2012/0272784 | A1 | 11/2012 | Bailey et al. | |
| 2012/0291824 | A1 | 11/2012 | Bhajak et al. | |
| 2013/0057131 | A1 * | 3/2013 | Ryu | A47L 15/507 312/228.1 |

FOREIGN PATENT DOCUMENTS

| | | | | |
|---|---|---|---|---|
| DE | EP 2377454 | A1 * | 10/2011 | A47L 15/50 |
| EP | 0855166 | A2 | 7/1998 | |
| EP | 1882439 | A1 | 1/2008 | |
| KR | 20090001791 | A * | 1/2009 | A47L 15/50 |

* cited by examiner

*Primary Examiner* — Michael Barr
*Assistant Examiner* — Cristi Tate-Sims

(57) ABSTRACT

A dishwasher includes a rack assembly with a modular handle for allowing a user to grasp and pull out the rack. The modular handle includes a front piece, a rear body, and two end caps, which fit together to form an aesthetically pleasing handle suitable for the temperature and humidity in a dishwasher environment.

19 Claims, 8 Drawing Sheets

DISHWASHER RACK HANDLE

BACKGROUND OF THE INVENTION

Most domestic dishwashers for use in a typical household include a wash tub and a lower rack and an upper rack for storing utensils during a wash cycle in which the stored utensils are cleaned. In some dishwashers, some type of handle is provided on the front portion of either or both racks to allow a user to grasp and pull out the rack.

BRIEF DESCRIPTION OF THE INVENTION

In one embodiment, a dishwasher comprises a tub at least partially defining a wash chamber and having an open face providing access to the wash chamber and a sump, a door selectively closing the open face; a dish rack for supporting dishes in a dishwasher located within the wash chamber, and a modular handle comprising a U-shaped front piece, a back support, and two end caps. At least a portion of the dish rack is received between the U-shaped front piece and back support.

In another embodiment, a dishwasher rack assembly comprises a bottom wall formed by a plurality of wire members, a sidewall formed by a plurality of wire members and having an upper perimeter edge, a modular handle comprising a U-shaped stainless steel nameplate, a back support, and two end caps. At least a portion of the dish rack is received between the U-shaped front piece and back support.

In another embodiment, a dishwasher rack assembly comprises a bottom wall formed by a plurality of wire members, a sidewall formed by a plurality of wire members and having an upper perimeter edge, a modular handle comprising a U-shaped stainless steel nameplate, a center support, a back support, and two end caps. At least a portion of the dish rack is received between the U-shaped front piece and the center support.

DESCRIPTION OF EMBODIMENTS OF THE INVENTION

Figure 1:
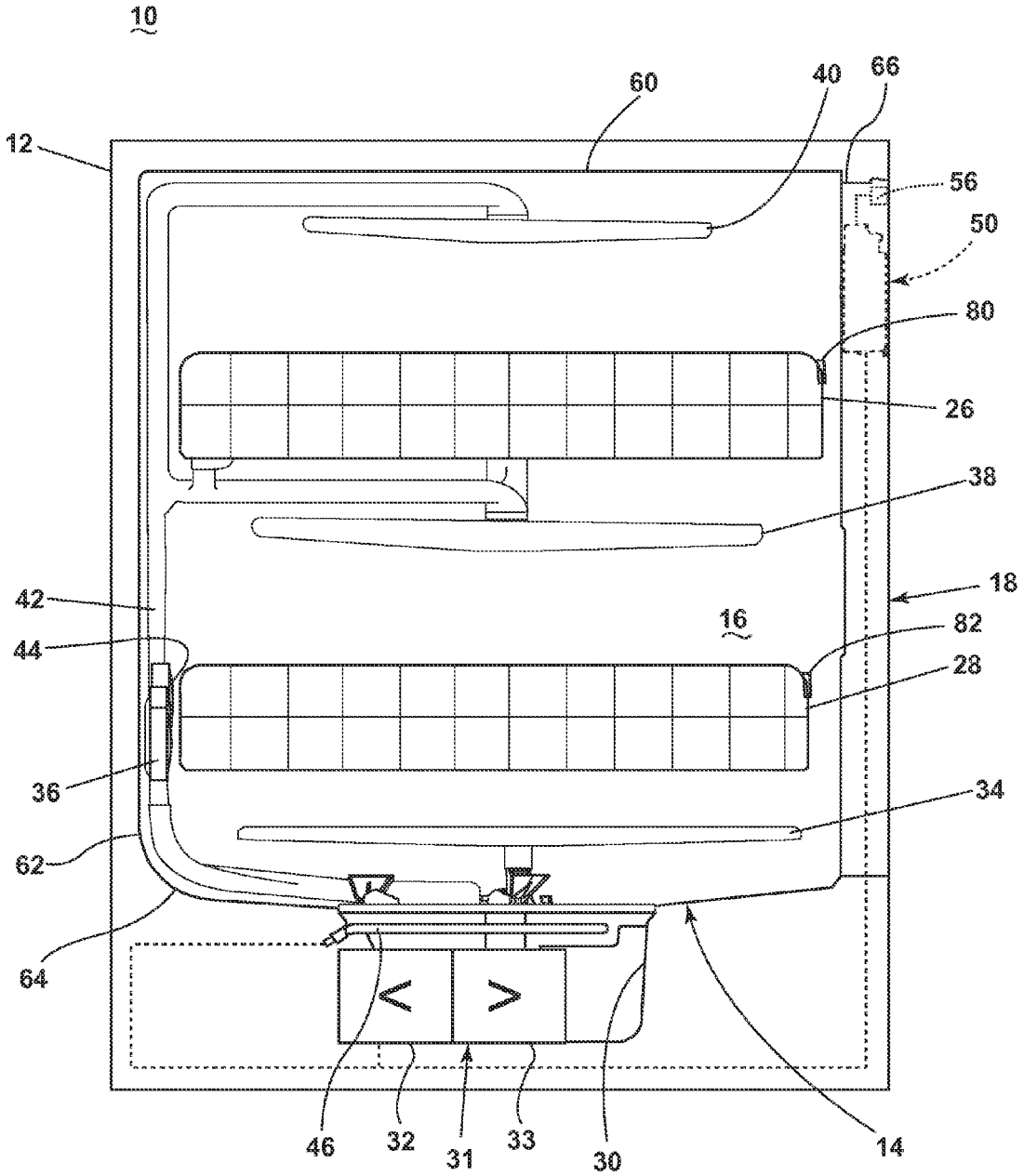
FIG. 1 is a schematic, cross-sectional view of a dishwasher showing a rack assembly according to a first embodiment.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
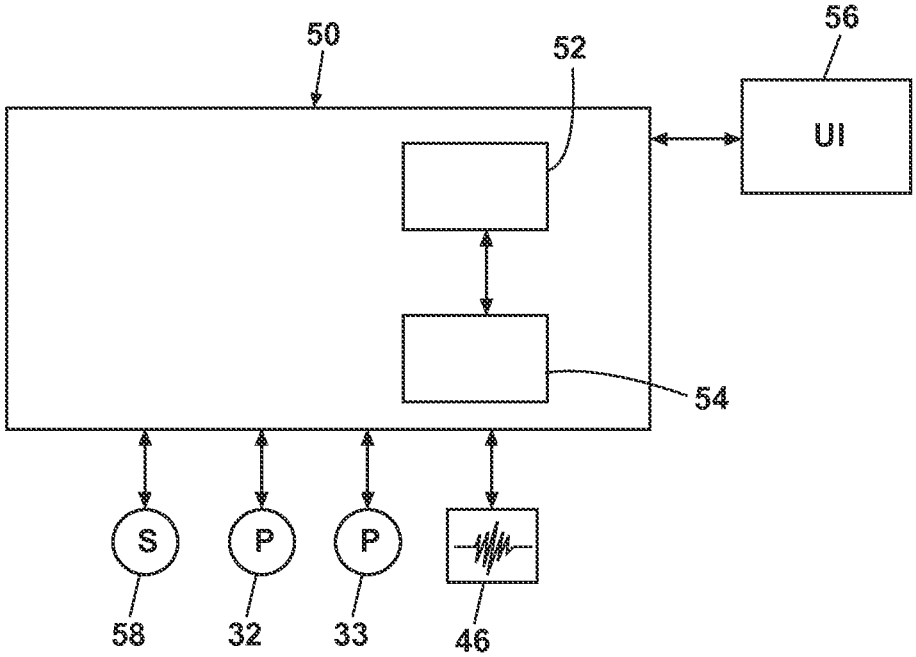
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
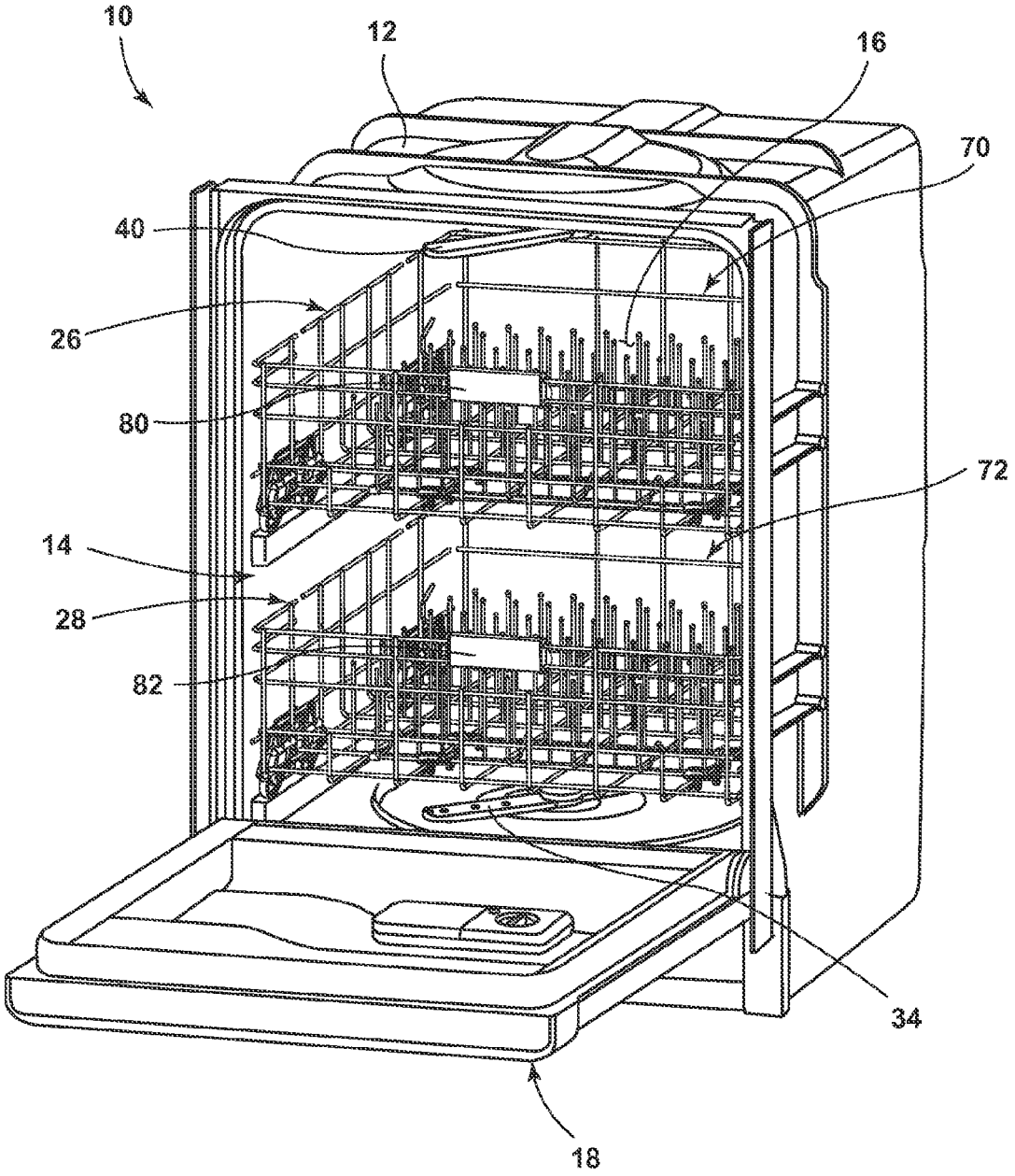
FIG. 3 is a perspective view of the dishwasher of FIG. 1 showing upper and lower dish rack assemblies according to one embodiment.

FIG. 3 provides a perspective view of the dishwasher 10 showing the exemplary upper and lower rack assemblies 26, 28. The upper and lower rack assemblies 26, 28 may each include a wire frame rack 70, 72 and a corresponding handle 80, 82.

Figure 4:
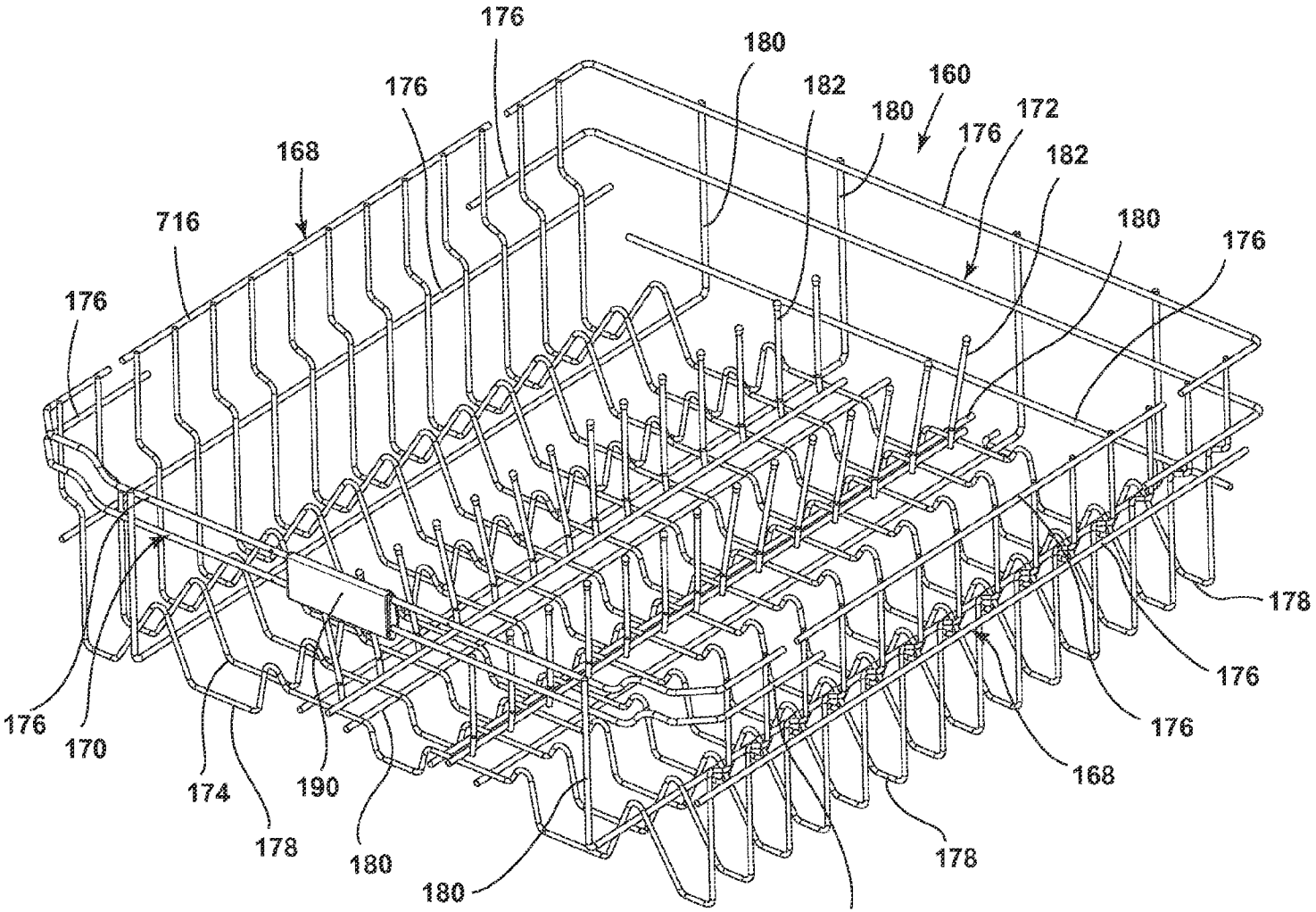
FIG. 4 is a perspective view of an upper rack assembly of FIG. 3 having a modular handle.

A wire frame rack 160 for the upper rack assembly 26 may be viewed in detail in the perspective view in FIG. 4. The exemplary wire frame rack 160 may have a peripheral wall formed by a pair of opposed side walls 168 joined by a front wall 170 and a rear wall 172 and a bottom wall 174 joining the lower ends of the peripheral wall 168, 170, 172. The peripheral walls 168, 170, 172 and the bottom wall 174 may be constructed by a plurality of wire elements. Peripheral wire elements 176 may extend generally horizontally around at least around a portion of the periphery of the wire frame rack 160, and side-to-side (extending generally in the direction defined between the side walls 168) and front-to-rear (extending generally in the direction between the front and rear walls 170, 172) intersecting wire elements 178, 180 may intersect one another to form the bottom wall 174. Additionally, the intersecting wire elements 178, 180 may turn upward at their ends in a generally vertical direction to, together with the peripheral wire elements 176, form the peripheral wall 168, 170, 172. Optionally, tines 182 may be integrated with or mounted to the upper wire frame rack 70. Construction of the wire frame rack 160 is not limited to the description above, but may be designed in any known manner.

The wire frame rack 160 may include a modular handle 190 secured to the wire frame rack 160. The handle 190 may be mounted to the peripheral wire elements 176 on the front wall 170 for easy accessibility.

Figure 5:
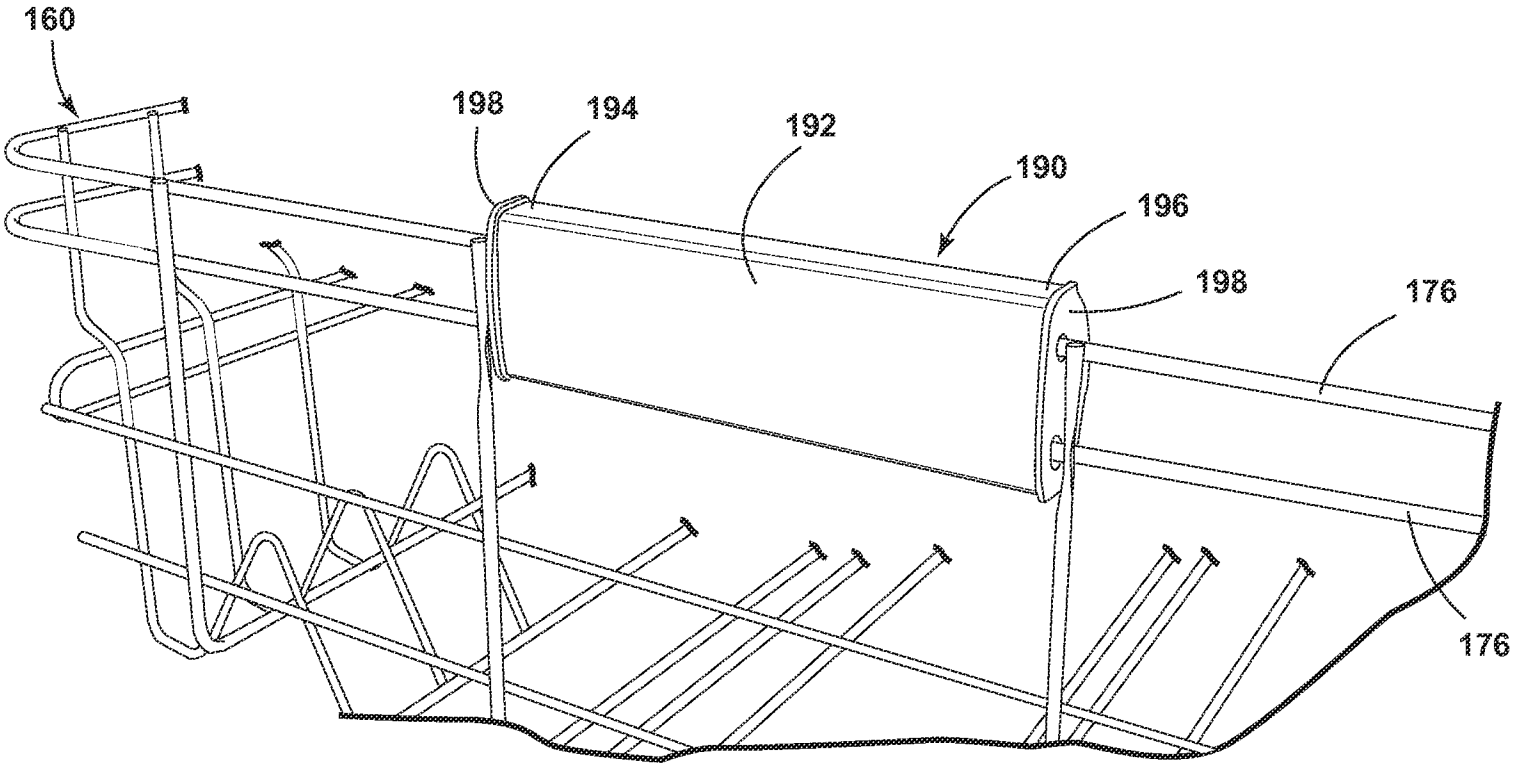
FIG. 5 is a perspective view of the modular handle of FIG. 4 according to a first embodiment.

Turning now to FIG. 5, which provides a perspective view of the modular handle 190. The handle 190 includes a U-shaped front plate 192 having a first edge 194 and a second edge 196. Preferably, the front plate 192 is stainless steel or other high-end material suitable for the temperature and humidity in a dishwasher environment. Front bodies 198 engage each of the first and second edges 194, 196 of the front plate 192. The front bodies 198 may be formed from plastic or other lower-cost material suitable for the temperature and humidity in a dishwasher environment.

Figure 6:
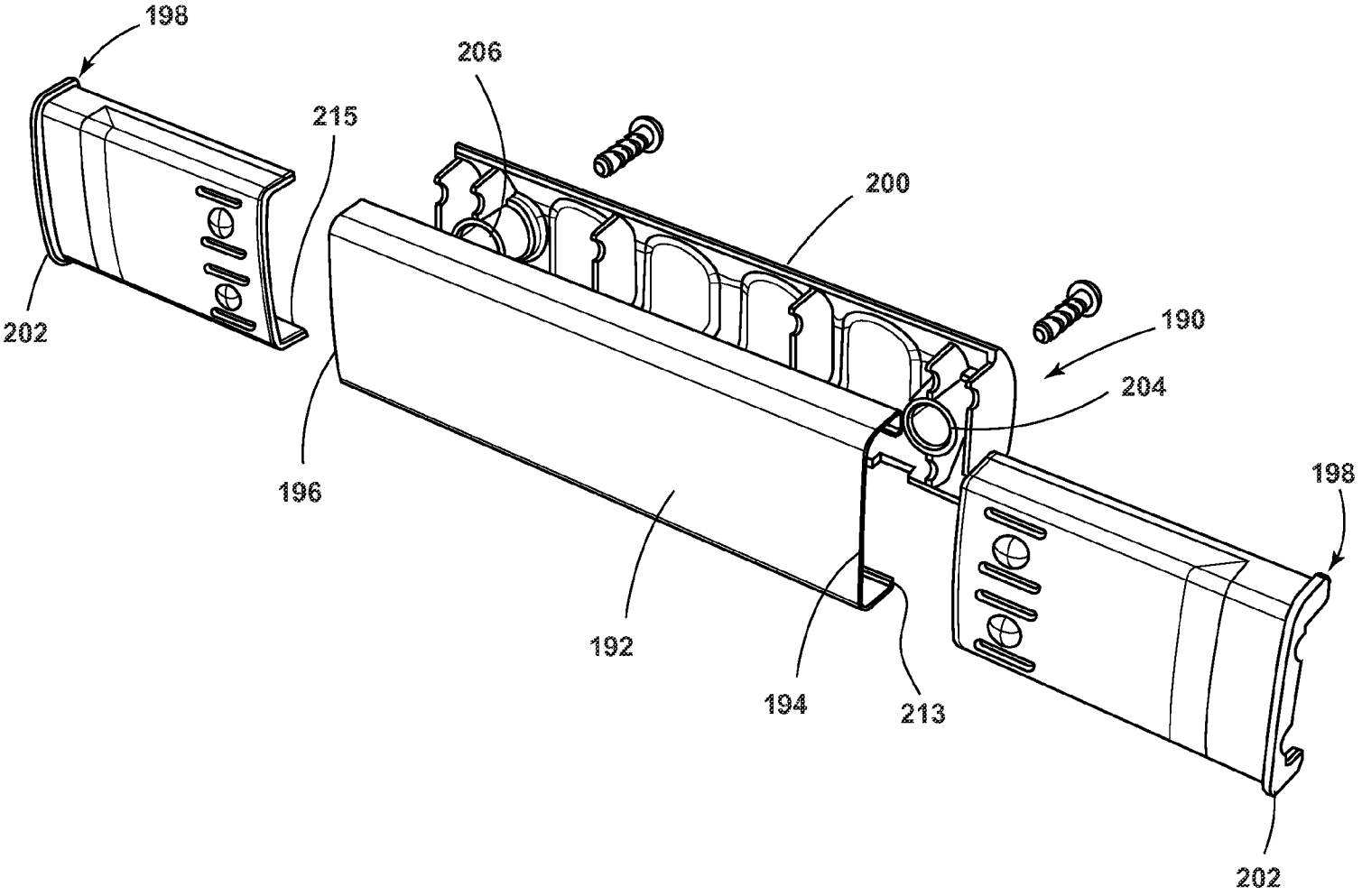
FIG. 6 is an exploded view of the modular handle of FIG. 3 according to a first embodiment.

FIG. 6 illustrates an exploded view of the modular handle 190. It can be seen that the handle 190 includes a rear body 200. The rear body 200 may be formed from plastic or other lower-cost material suitable for the temperature and humidity in a dishwasher environment. The front bodies 198 include a raised outer edge 202. The front bodies 198 are slidably received by the U-shaped front plate 192 such that the raised outer edge 202 of each front body 198 captures the front plate 192. The front bodies 198 may each include a cylindrical or tapered opening configured to engage a screw or other suitable fastening member as the screw is turned (not shown). The rear body 200 may include a first cylindrical passageway 204 and a second cylindrical passageway 206 to allow the screw or other suitable fastening member to pass through the rear body 200 such that the screw does not extend past a rear surface 215 (shown in FIG. 7) of the rear body 200. When the front bodies 198 are received by the U-shaped front plate 192, the first and second cylindrical passageways 204, 206 substantially align with the cylindrical or tapered openings on the front plate 192 such that the fastening member passes through the first and second cylindrical passageways 204, 206 to engage the cylindrical or tapered openings on the front plate 192. The rear body 200 may engage with the front bodies 198 when the front bodies 198 are inserted into the U-shaped front plate. The front plate 192 may include a front rib 213 designed to engage a groove on the front bodies 198, such that the front bodies 198 are captured by the U-shaped front plate 192 when engaged with the rear body 200.

Figure 7:
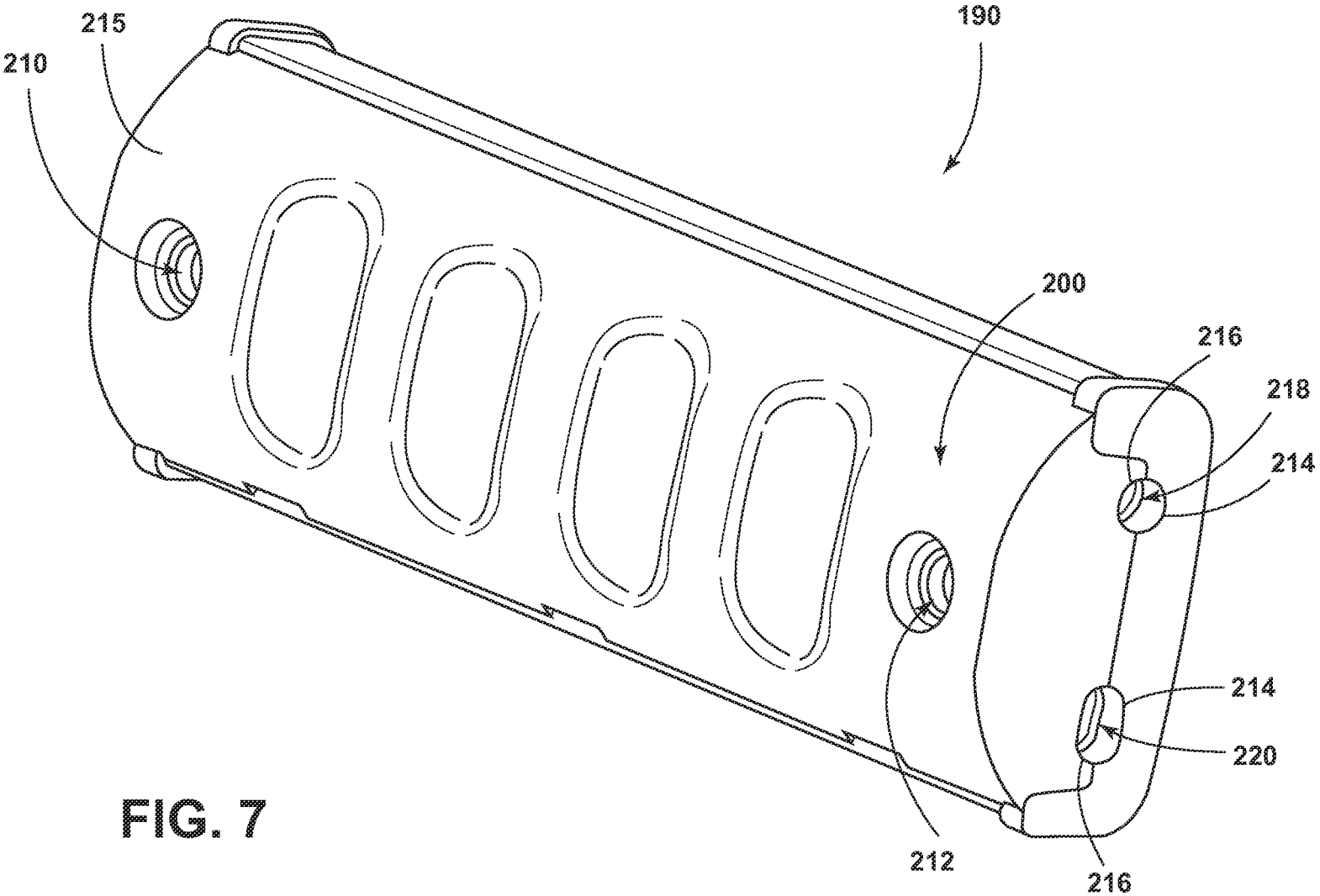
FIG. 7 is a perspective view of the back of the modular handle of FIG. 3 according to a first embodiment.

FIG. 7 is a perspective view of the modular handle 190. The rear body 200 may include a first recessed portion 210 and a second recessed portion 212. The first recessed portion 210 corresponds to the first cylindrical passageway 204, and the second recessed portion 212 corresponds to the second cylindrical passageway 206 to allow fastening members to pass through the rear body to engage the cylindrical or tapered openings in the front bodies 198. The front bodies 198 may include at least one front curved opening 214. The rear body 200 may include at least one rear curved opening 216. When assembled, the front curved openings 214 correspond to the rear curved openings 216 to create an upper opening 218 and a lower opening 220, both designed to engage the wire rack 160. The upper opening 218 may be designed to fit more tightly around the peripheral wire elements 176 of the wire rack 160, while the lower opening 220 may be larger such that it floats around peripheral wire elements 176 of the wire rack 160.

Figure 8:
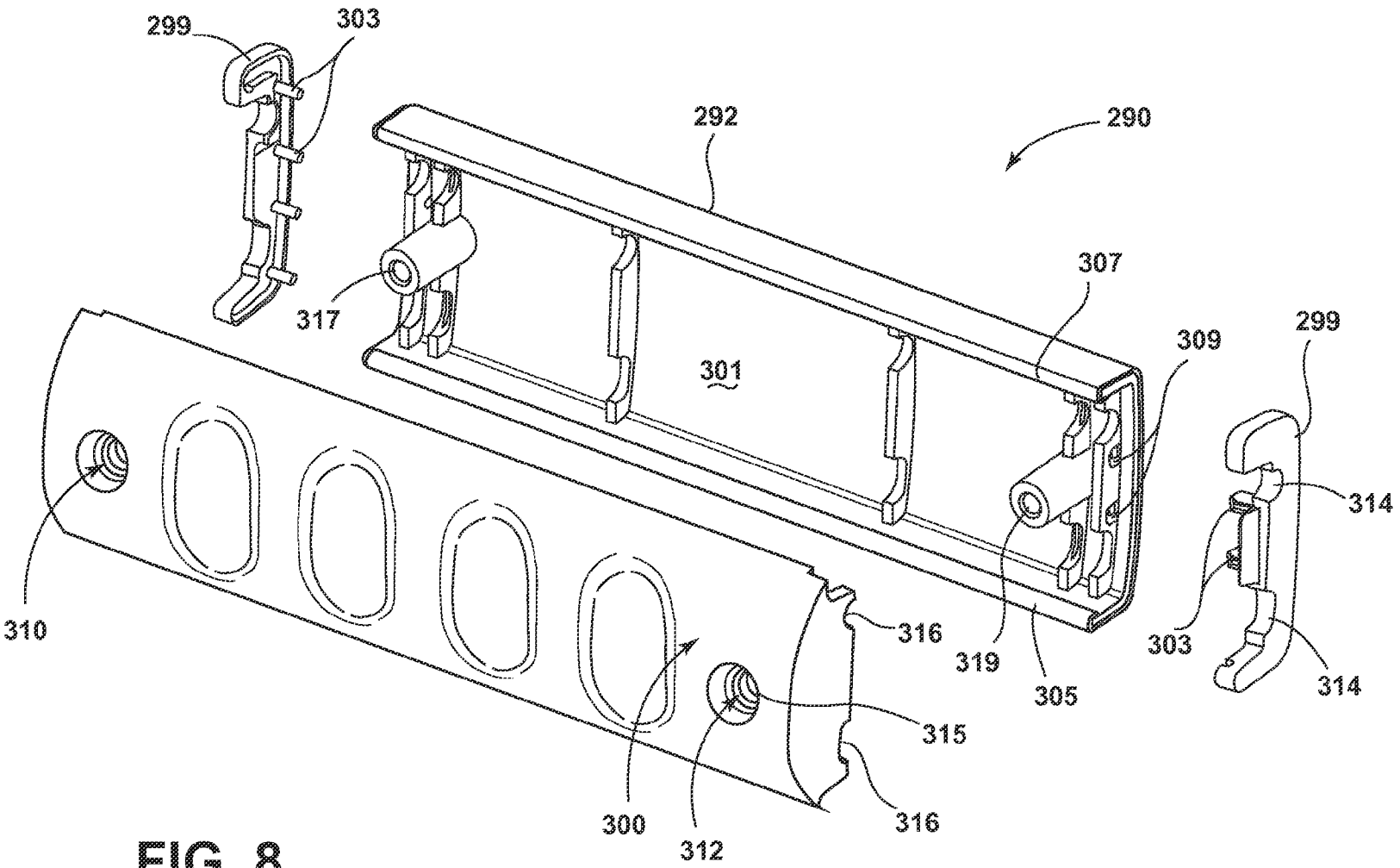
FIG. 8 is an exploded view of the modular handle of FIG. 3 according to a second embodiment.

Turning now to FIG. 8, an exploded rear view of a second embodiment of a modular handle 290 is shown. It can be seen that the handle 290 includes a U-shaped front plate 292, two end caps 299, a center fastening piece 301, and a rear body 300. Preferably, the front plate 292 is stainless steel or other high-end material suitable for the temperature and humidity in a dishwasher environment. The end caps 299, center fastening piece 301, and rear body 300 may be formed from plastic or other lower-cost material suitable for the temperature and humidity in a dishwasher environment.

The end caps 299 may include at least one protrusion 303. The protrusions 303 may have a variety of shapes including, but not limited to, cylinders or rectangular cuboids. The U-shaped front plate 292 may include a lower lip 305 and an upper lip 307. The center fastening piece 301 is slidably received by the U-shaped front plate 292 such that the lip lower lip 305 and the upper lip 307 of the U-shaped front plate 292 capture the center fastening piece 301. The center fastening piece 301 may include at least one recess or hole 309 to engage with the protrusions 303 to act as an engagement feature. Alternately, the center fastening piece 301 may include at least one protrusion, and the end caps 299 may include at least one recess or hole. Other known snap fit mechanisms may also be used.

The center fastening piece 301 may include a first cylindrical or tapered opening 317 and a second cylindrical or tapered opening 319 configured to engage a screw or other suitable fastening member as the screw is turned (not shown). The rear body 300 may include a first cylindrical passageway and a second cylindrical passageway (not shown) to allow the screw or other suitable fastening member to pass through the rear body 300. The rear body may also include a first recessed portion 310 and a second recessed portion 312. The first recessed portion 310 corresponds to the first cylindrical passageway 304, and the second recessed portion 312 corresponds to the second cylindrical passageway 306 to allow fastening members to pass through the rear body 300 to engage the cylindrical or tapered openings 317, 319 in the center fastening piece 301 such that the screw does not extend past a rear surface 315 of the rear body 300. When the center fastening piece 301 is received by the U-shaped front plate 292, the first and second cylindrical passageways 310, 312 substantially align with the first and second cylindrical passageways 310, 312 such that the fastening member passes through the first and second cylindrical passageways 310, 312 to engage the first and second cylindrical or tapered openings 317, 319 on the center fastening piece 301. The rear body 300 may engage with the center fastening piece 301 when the center fastening piece 301 is inserted into the U-shaped front plate 292. The end caps 299 may engage the center fastening piece 301 either before or after the rear body 300 engages with the center fastening piece 301.

The end caps 199 may include at least one front curved opening 314. The rear body 300 may include at least one rear curved opening 316. When assembled, the front curved openings 314 correspond to the rear curved openings 316 to create an upper opening and a lower opening (not shown), both designed to engage the wire rack 160. The upper opening may be designed to fit more tightly around the peripheral wire elements 176 of the wire rack 160, while the lower opening may be larger such that it floats around peripheral wire elements 176 of the wire rack 160.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a wash chamber and having an open face providing access to the wash chamber and a sump;

a door selectively closing the open face;

a dish rack for supporting dishes in a dishwasher located within the wash chamber; and a modular handle comprising a U-shaped front piece, a back support, and two end caps;

wherein the U-shaped front piece forms a rib and the end caps include grooves that slidably fit into the rib; and wherein at least a portion of the dish rack is received between the U-shaped front piece and the back support.

2. The dishwasher of claim 1, wherein the U-shaped front piece and the back support are form-fitted with the rack so as to capture a part of the rack between the U-shaped front piece and the back support and the modular handle is secured to the rack.

3. The dishwasher of claim 1, wherein at least one mechanical fastener secures the U-shaped front piece to the back support.

4. The dishwasher of claim 3, wherein the mechanical fastener is a screw.

5. The dishwasher of claim 3, wherein the mechanical fastener is a snap fixture.

6. A dishwasher rack assembly comprising:

a bottom wall formed by a plurality of wire members;

a sidewall formed by a plurality of wire members and having an upper perimeter edge; and a modular handle comprising a formed metal U-shaped front piece, a molded plastic back support, and two end caps;

wherein at least a portion of the dishwasher rack is received between the U-shaped front piece and the back support; and wherein the end caps are slideably received by the U-shaped front piece such that a raised outer edge of the end caps captures the front piece.

7. The dishwasher rack assembly of claim 6, wherein the U-shaped front piece and the back support are form-fitted with the rack so as to capture a part of the rack between the U-shaped front piece and the back support and the modular handle is secured to the rack.

8. The dishwasher rack assembly of claim 6, wherein at least one mechanical fastener secures the U-shaped front piece to the back support.

9. The dishwasher rack assembly of claim 8, wherein the mechanical fastener is a screw.

10. The dishwasher rack assembly of claim 8, wherein the mechanical fastener is a snap fixture.

11. The dishwasher rack assembly of claim 6, wherein the U-shaped front piece forms a rib and the end caps include grooves that slidably fit into the rib.

12. A dishwasher rack assembly comprising:

a bottom wall formed by a plurality of wire members;

a sidewall formed by a plurality of wire members and having an upper perimeter edge;

a modular handle comprising a formed metal U-shaped front piece, a molded plastic center support, a molded plastic back support, and two end caps;

wherein the molded plastic center support is assembled with the U-shaped front piece to form a front handle piece:

wherein at least a portion of the dishwasher rack is received between the front handle piece and the back support: and wherein the end caps are slideably received by the plastic center support such that a raised outer edge of the end caps captures an edge of the front piece.

13. The dishwasher rack assembly of claim 12, wherein the U-shaped front piece and center support are form-fitted with the rack so as to capture a part of the rack between the U-shaped front piece and the back support when the modular handle is secured to the rack.

14. The dishwasher rack assembly of claim 12, wherein at least one mechanical fastener secures the center support to the back support.

15. The dishwasher rack assembly of claim 14, wherein the mechanical fastener is a screw.

16. The dishwasher rack assembly of claim 14, wherein the mechanical fastener is a snap fixture.

17. The dishwasher rack assembly of claim 12, wherein the U-shaped front piece forms a rib and the center support and end caps include grooves that slidably fit into the rib.

18. The dishwasher rack assembly of claim 12, wherein the end caps contain protrusions which engage holes in the center support.

19. The dishwasher rack assembly of claim 12, wherein the center support contains protrusions which engage holes in the end caps.

* * * * *